US006738999B1

(12) United States Patent
Lingegård et al.

(10) Patent No.: US 6,738,999 B1
(45) Date of Patent: May 25, 2004

(54) APPARATUS TO ASSIST DISABLED PERSONS

(75) Inventors: Hans Lingegård, Eslöv (SE); Bo Persson, Löddeköpinge (SE); Håkan Hagström, Lund (SE); Deni Dimovski, Eslöv (SE)

(73) Assignee: Arjo Hospital Equipment AB, Eslov (SE)

( * ) Notice: Subject to any disclaimer, the term of this patent is extended or adjusted under 35 U.S.C. 154(b) by 0 days.

(21) Appl. No.: 09/700,629

(22) PCT Filed: May 21, 1999

(86) PCT No.: PCT/SE99/00882

§ 371 (c)(1),
(2), (4) Date: Dec. 21, 2000

(87) PCT Pub. No.: WO99/60977

PCT Pub. Date: Dec. 2, 1999

(30) Foreign Application Priority Data

May 22, 1998 (SE) ..... 9801850-

(51) Int. Cl.[7] ..... A61G 5/00
(52) U.S. Cl. ..... 5/81.1 R; 5/86.1
(58) Field of Search ..... 5/81.1 R, 86.1, 5/87.1; 297/DIG. 4, 317, 322, 325, 344.12, 344.13

(56) References Cited

U.S. PATENT DOCUMENTS 3,694,829 A * 10/1972 Bakker ..... 5/86.1
4,574,901 A * 3/1986 Joyner ..... 180/65.1
4,893,827 A * 1/1990 Gay et al. ..... 280/250.1
5,201,084 A * 4/1993 Johnson ..... 254/102
5,685,034 A 11/1997 Kleer et al. ..... 5/604

FOREIGN PATENT DOCUMENTS

| | | |
|---|---|---|
| JP | 06134005 | 5/1994 |
| JP | 08299114 | 11/1996 |
| JP | 10033595 | 2/1998 |
| NL | 8701561 | 2/1989 |

OTHER PUBLICATIONS

Patent Abstracts of Japan JP 10033595 dated Feb. 10, 1998.

Patent Abstracts of Japan JP 06134005 dated May 17, 1994.

Patent Abstracts of Japan JP 08299114 dated Nov. 19, 1996.

* cited by examiner

*Primary Examiner*—Teri Pham Luu
*Assistant Examiner*—Fredrick Conley
(74) *Attorney, Agent, or Firm*—Ladas and Parry

(57) ABSTRACT

The invention relates to an apparatus for facilitating, in handicapped patients, undressing, dressing and access to body parts between the waist and knees of the patient. The apparatus includes a seat (20) and a back support (10) which between them form an open region (11) in which a person located in the apparatus is not supported. The seat and the back support are disposed to be displaced between positions in which the person is placed in positions where the major proportion of the patient's weight is carried by the seat or in which the major proportion of the patient's weight is carried by the back support.

10 Claims, 12 Drawing Sheets

APPARATUS TO ASSIST DISABLED PERSONS

Figure 1A:
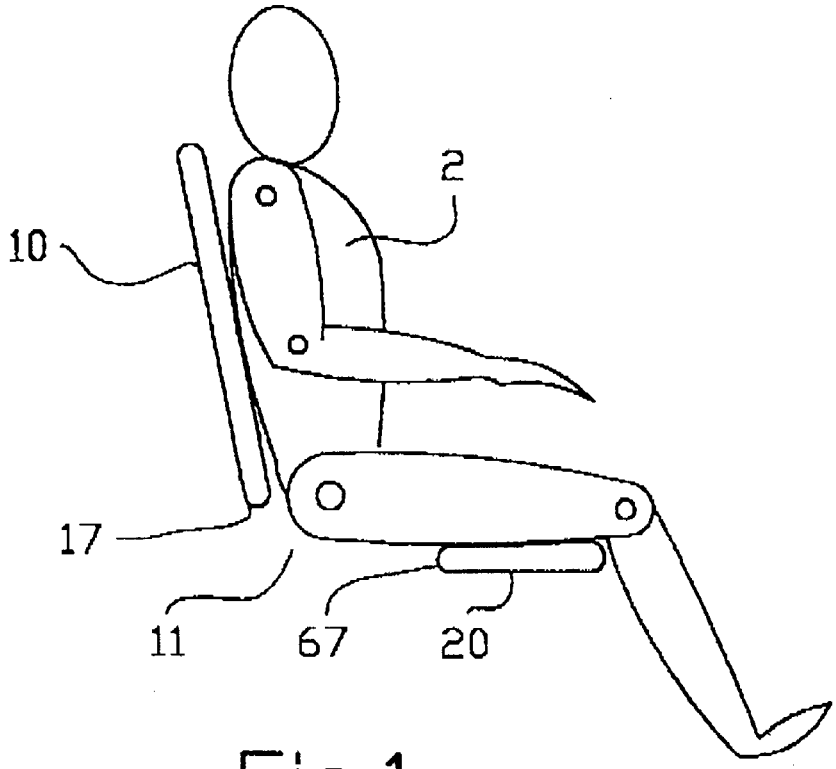
Figure 1B:
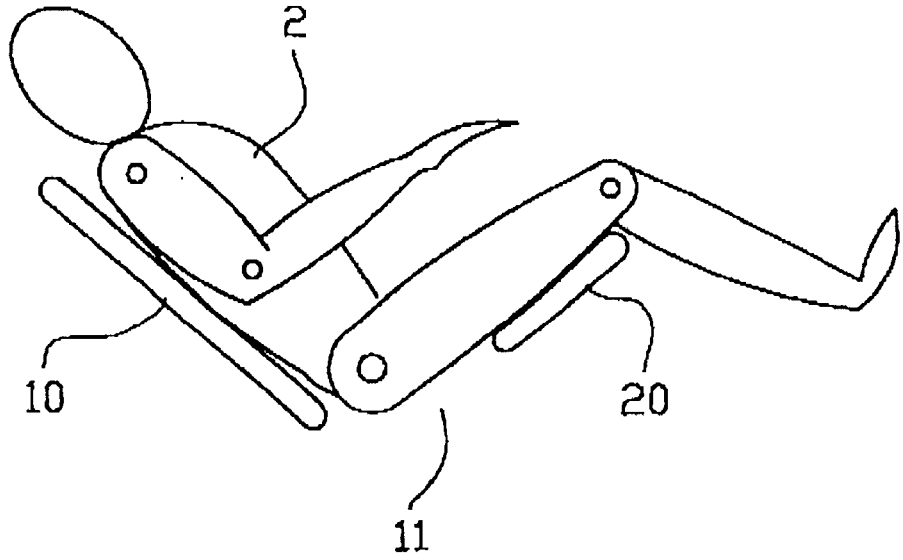

The present invention relates to an apparatus for facilitating, in handicapped people or patients, the undressing and dressing of the abdominal region and also to facilitate access thereto.

In this disclosure, the term abdominal region is employed to signify that portion of a human body which begins at the waist and ends at the knees.

There is a need in the art for an assistive apparatus which facilitates the handling of handicapped people or patients, for example in connection with visits to the toilet, in connection with undressing and dressing, in connection with such visits and when washing the abdominal region.

It is obvious that there is also a need to be able, in the dressed state, to move handicapped people, for example, from a bed or a chair to, for example, a toilet or a shower, etc., and when in place in the toilet area or shower area to prepare and place the person such that he/she may perform the necessary ablutions. It is also desirable that the return transport of the patient to the bed or the chair takes place in the clothed state. Naturally, it is also desirable that seated handicapped people (for example within geriatric care) be moved from and to the bed in the clothed state and be dressed or undressed at the bedside.

A further need in the art is that it should require only one carer to help a handicapped or sick person in connection with, for example, showering or a toilet visit. By limiting the need to but a single carer, the possibility is created for more time for the staff to assist and be together with, for example patients or residents at a home for the elderly.

A further wish that has been voiced within the care sector is to reduce the requirements on heavy lifting.

The present invention relates to an apparatus in which the above-outlined needs and wishes have been satisfied. This is put into effect by means of the technology as disclosed in the characterizing clause of the appended independent Claim.

The apparatus according to the present invention consists of a seat and a back support which are disposed to form between them an open area in which a person located in the apparatus is not supported. The apparatus includes means for displacing the seat and the back support between a first position in which the person is substantially entirely supported by the seat and to a second position in which the person is substantially entirely supported by the back support.

In the first position, the possibility is created of pulling down, for example, the patient's trousers to a position in which, after switching of the apparatus to the second position, the trousers are not clamped between the patient and the apparatus. As a result, the trousers may be wholly or partly removed from the patient without the carer needing to carry out any heavy lifting operation.

In order to simplify the text, the word "trousers" has been employed in this disclosure and will also be employed below. While the word "trousers" is normally employed for a specific item of clothing, in this disclosure it has a much broader scope. A person skilled in the art will readily perceive that problems corresponding to those which exist in the undressing and dressing of trousers also occur in the undressing and dressing of many other forms and items of clothing such as underwear, skirts, stockings etc. and also diapers. The apparatus according to the present invention also facilitates undressing and dressing for such items of clothing, since the apparatus makes it possible progressively to exposure various parts of the abdomen from abutment against the apparatus. As a result, the word "trousers" is to be taken in this disclosure to relate to all forms of clothing for which the apparatus facilitates dressing or undressing of items of clothing, where the apparatus reduces the need for heavy lifting operations in connection with the dressing or undressing of items of clothing.

In undressing, the apparatus to the invention is, in a first step, set to a first position in which the upper portion and substantially the whole central area of the abdominal region of a person located in the apparatus are free from abutment against the apparatus, and in a second step is set to a second position in which substantially the entire central area of the abdominal region is free from abutment against the apparatus, while the lowermost area of the abdominal region (substantially only the lower part of the thighs or the central and lower parts of the thighs) abut against the apparatus with but light pressure. In the first position, it is simple to pull down the trousers to the patient's thighs and, in the second position, it is simple to continue the undressing operation by, if necessary, lifting the patient's legs (possibly one at a time) for continued removal of the trousers.

Expedient embodiments of the apparatus according to the present invention are disclosed in the appended subclaims.

Figure 2:
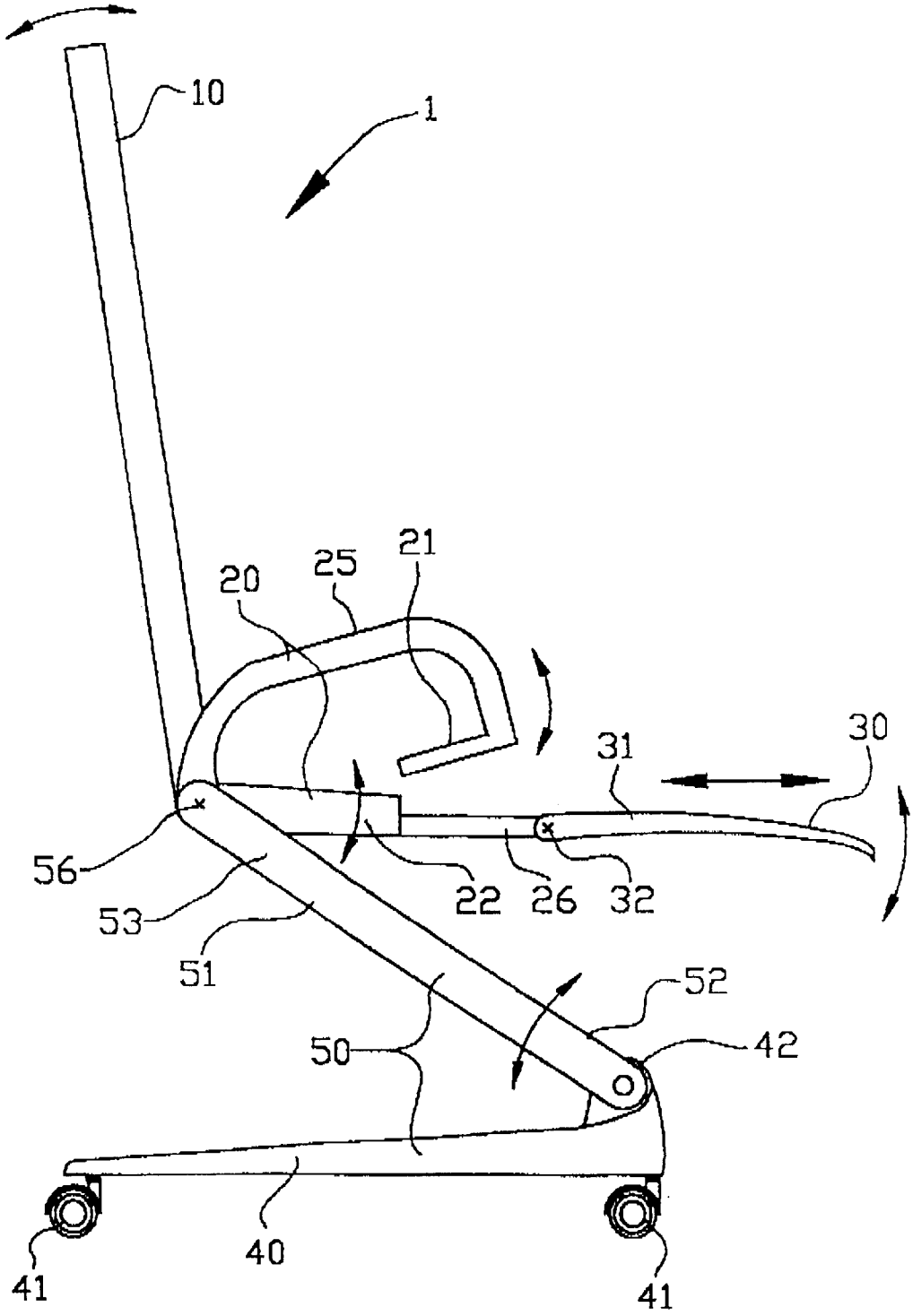
Figure 3A:
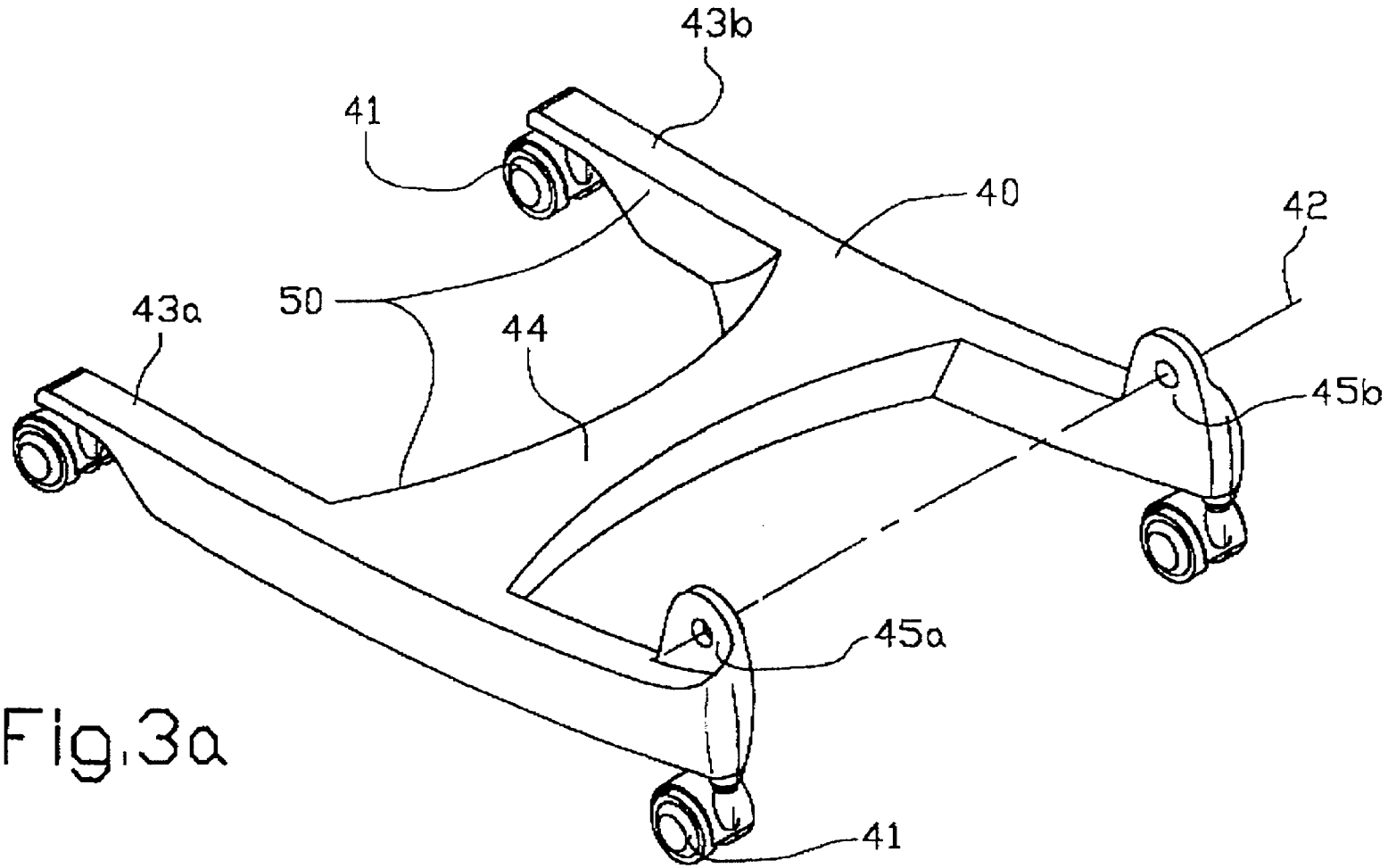
Figure 3B:
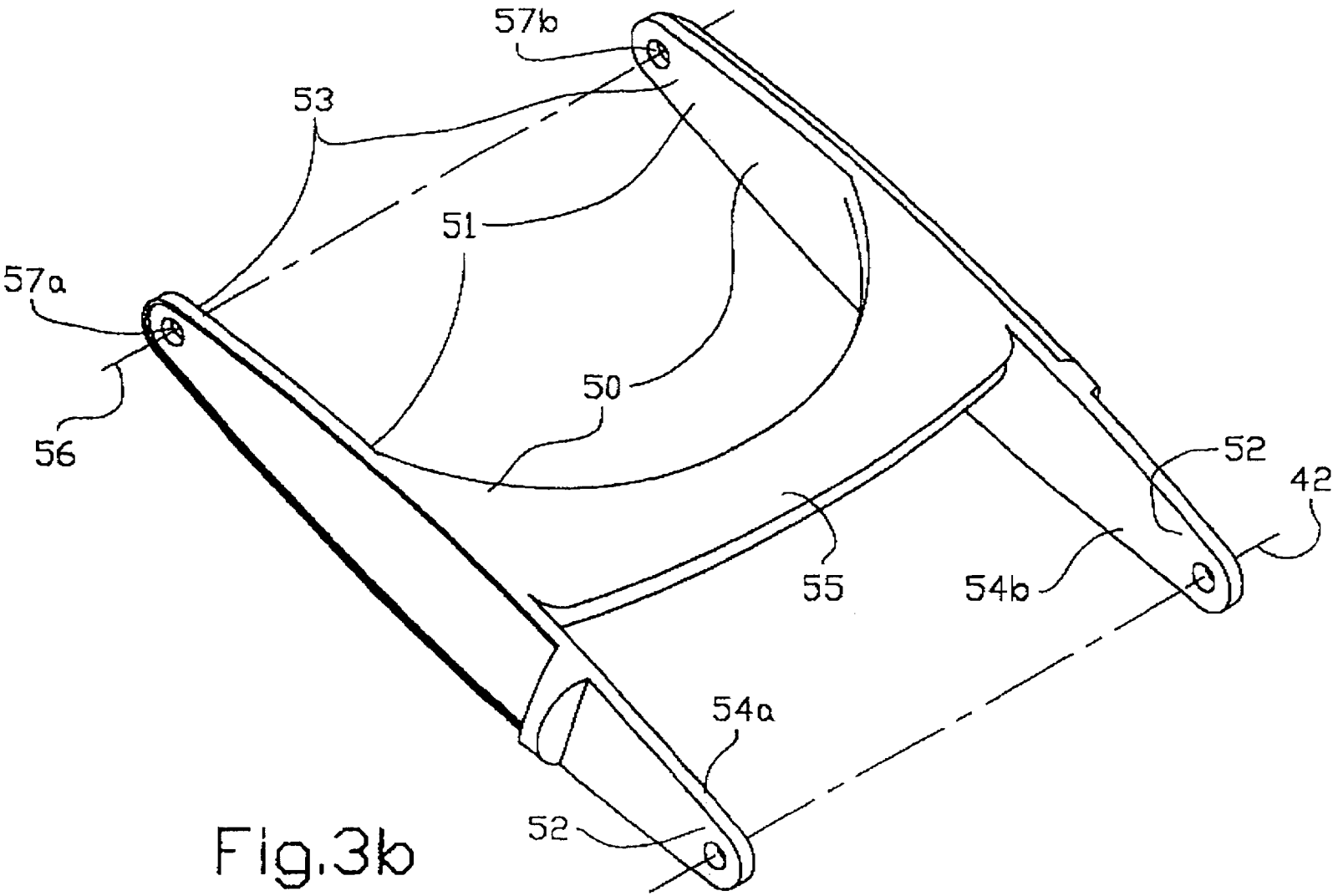
Figure 3C:
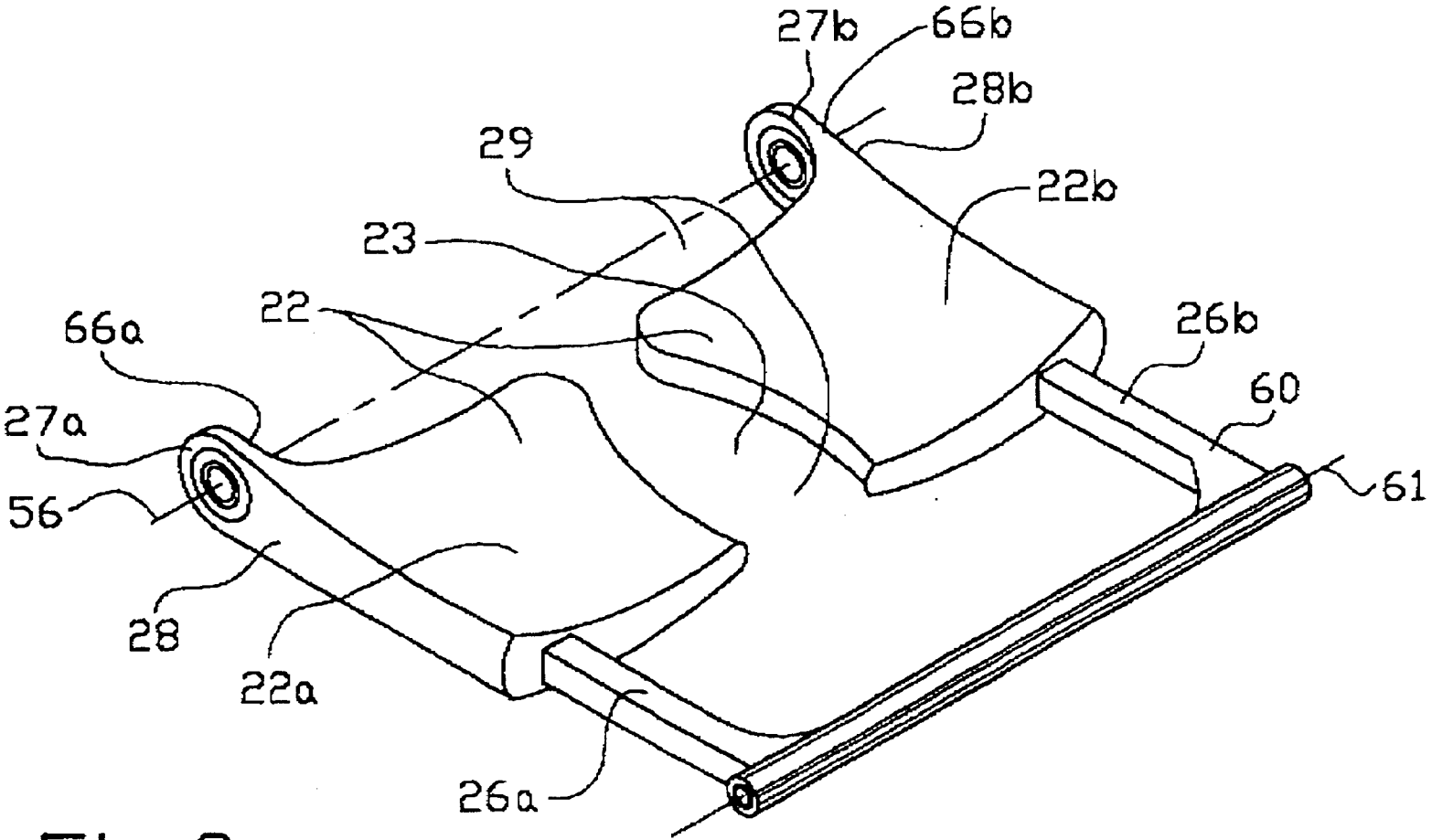
Figure 3D:
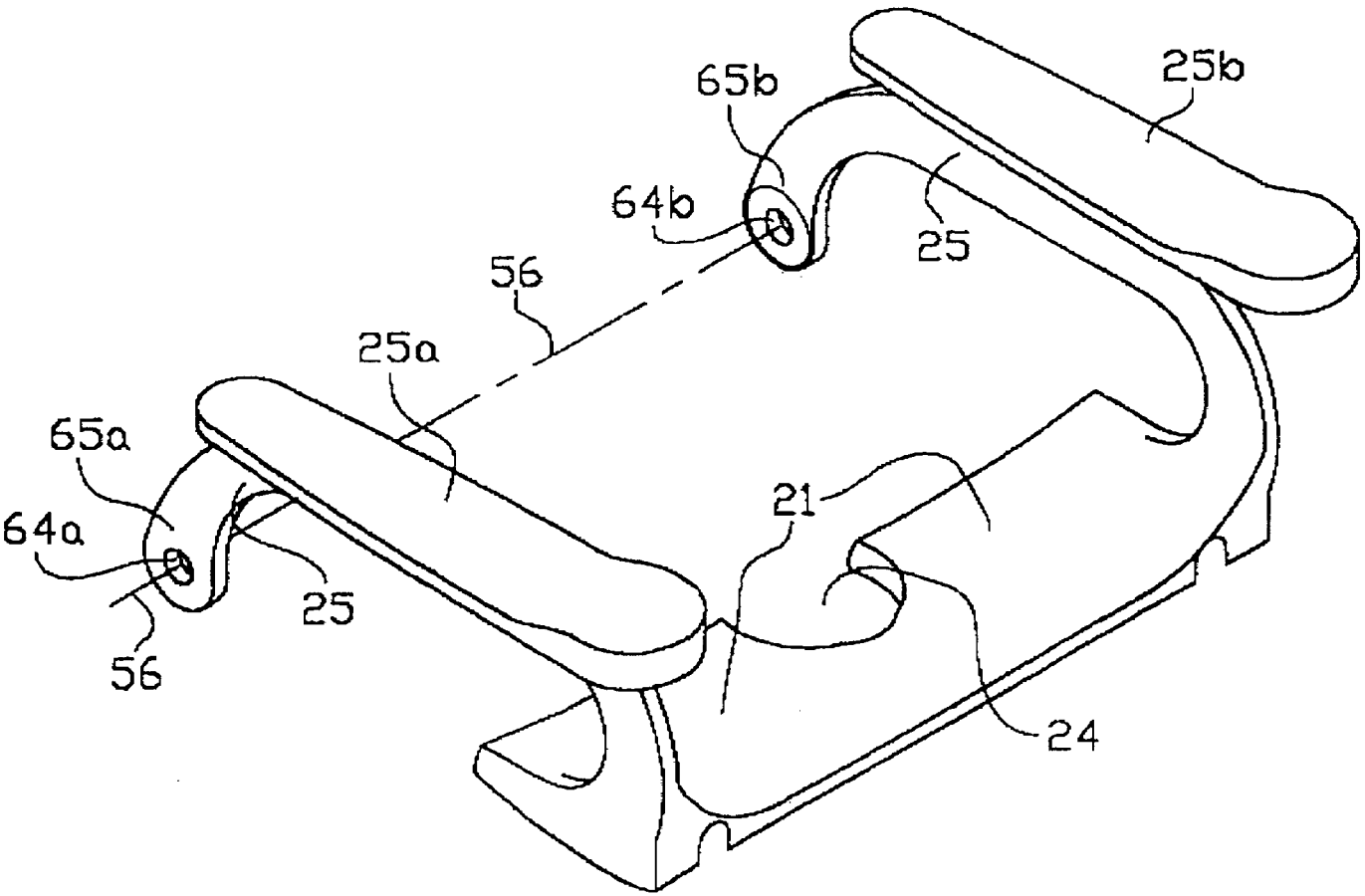
Figure 3E:
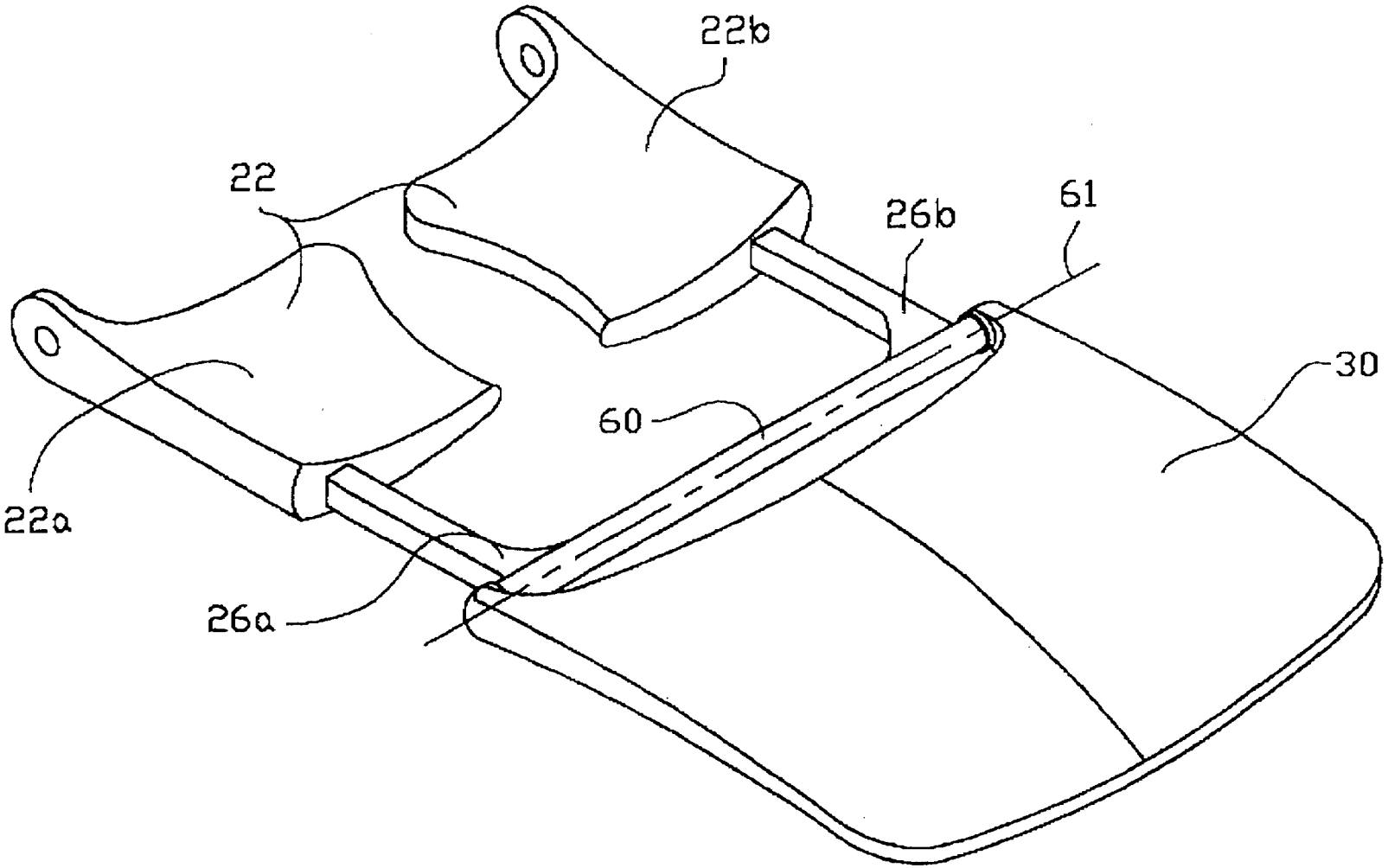
Figure 3F:
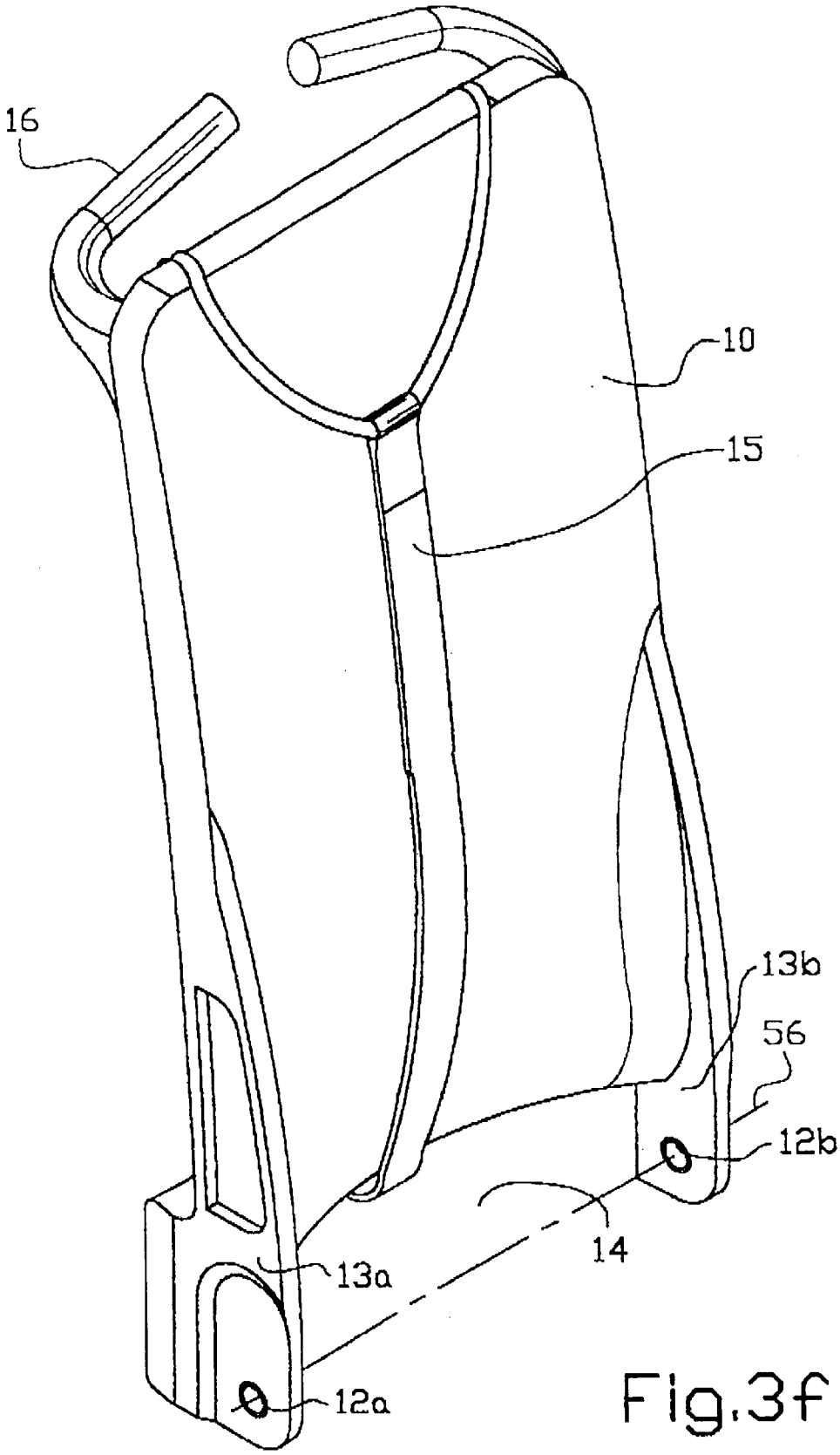
Figure 4A:
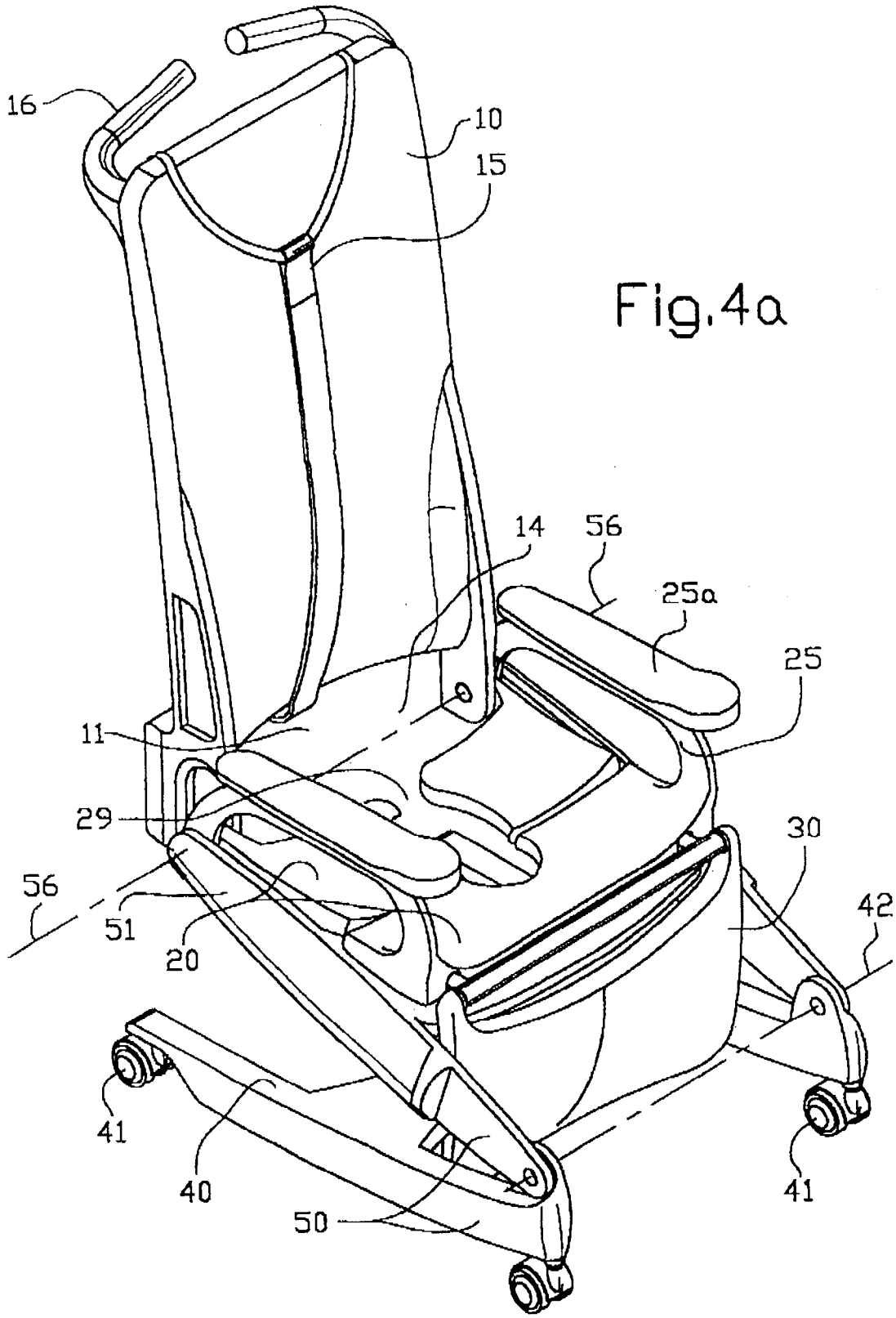
Figure 4B:
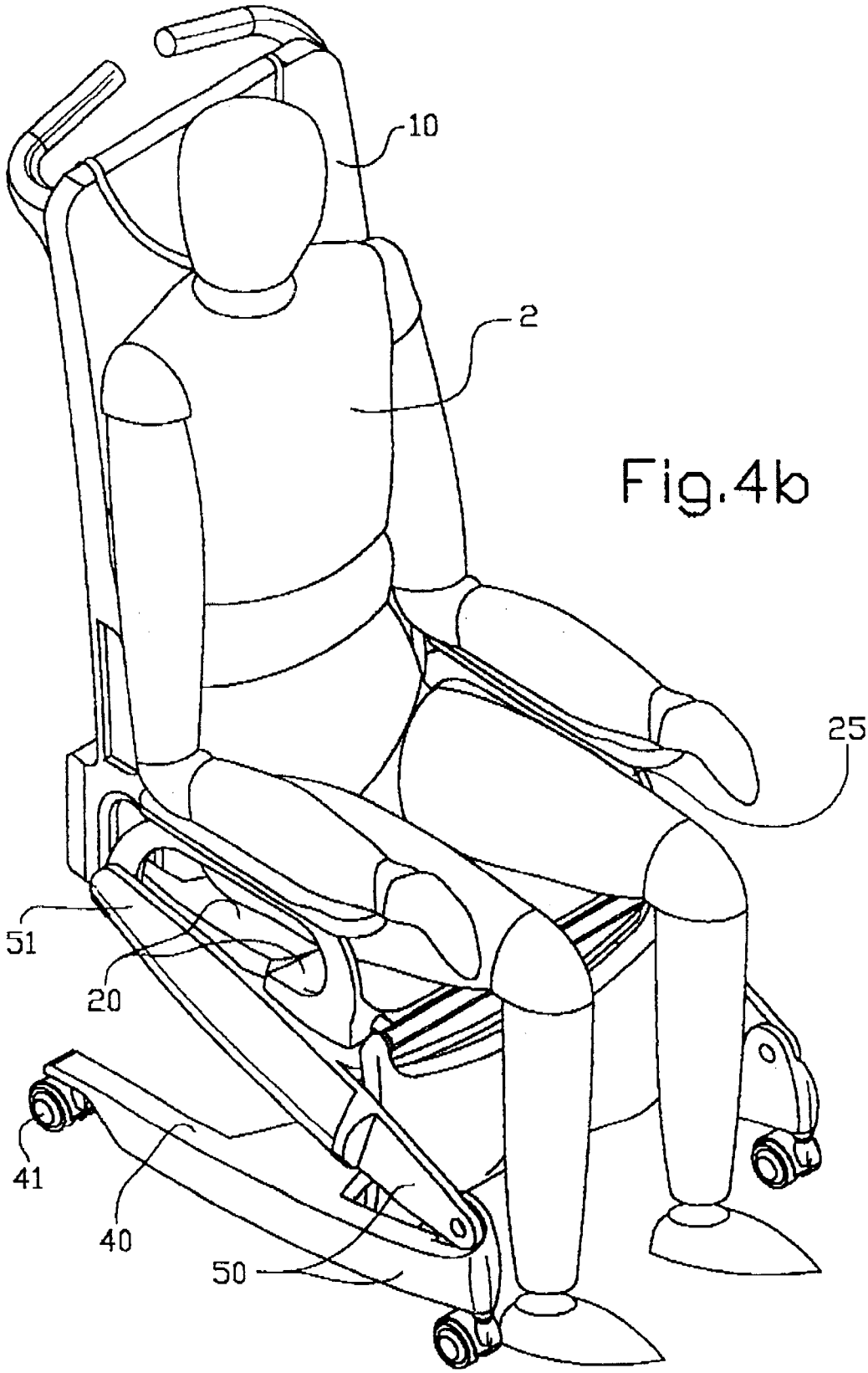
Figure 5A:
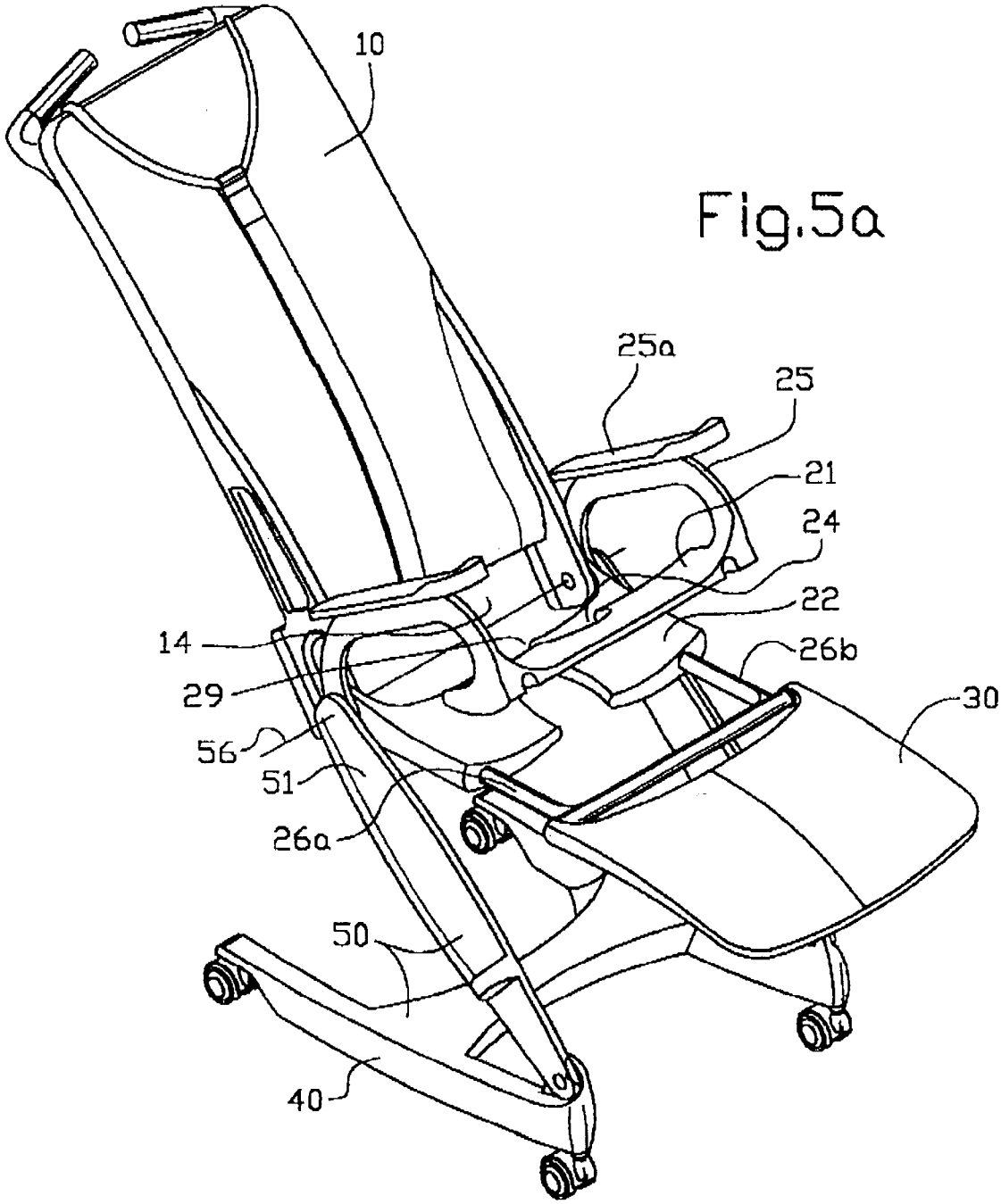
Figure 5B:
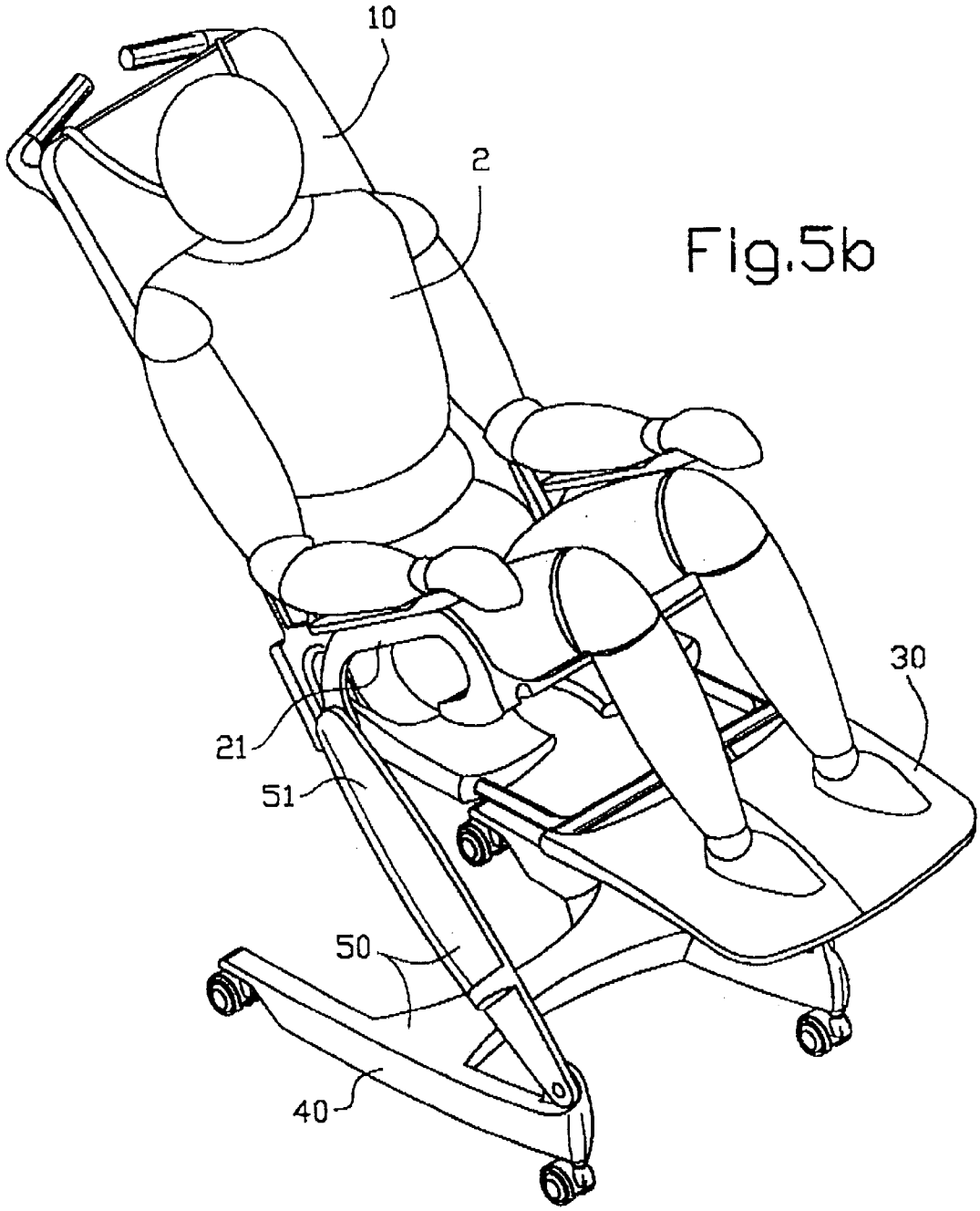

Embodiments of the present invention will now be described in greater detail hereinbelow, with reference to the accompanying drawings. In the accompanying drawings:

FIGS. 1*a, b* are schematic drawings showing the function of the apparatus;

FIG. 2 is a schematic drawing of means included in embodiments of the apparatus according to the present invention;

FIG. 3*a* is a perspective view of one embodiment of a chassis;

FIG. 3*b* is a perspective view of one embodiment of a frame;

FIGS. 3*c–d* are perspective views of means forming the seat of the apparatus;

FIG. 3*e* is a perspective view of one embodiment of a support for the lower part of the leg;

FIG. 3*f* is a perspective view of one embodiment of a back support;

FIG. 4*a* is a perspective view of one embodiment in which the apparatus is upright and set for moving a patient;

FIG. 4*b* is a perspective view corresponding to that of FIG. 4*a* with a patient sitting in the apparatus;

FIG. 5*a* is a perspective view of the apparatus corresponding to that of FIG. 4*a* in which the apparatus is reclined; and FIG. 5*b* is a perspective view corresponding to that of FIG. 4*a* with a patient sitting in the apparatus.

The apparatus 1 according to the present invention (cf. FIGS. 1*a,b*) comprises a seat 20 and a back support 10 where the seat and the back support are disposed to form between them an open area 11. The area is formed between a rear edge 67 of the seat and a lower edge 17 of the back support. The seat and the back support are carried (cf. FIG. 2) by a frame 50 whose lower region forms a chassis 40 provided with wheels 41.

FIG. 2 shows an embodiment in which the seat 20 is disposed between a front seat portion 21 and a rear seat portion 22. The rear seat portion 22 is located most proximal the back support 10 and the front seat portion 21 is located most distal from the back support 10. The front seat portion is intended to support the lower parts of a patient's legs and the rear seat portion is intended to support the upper parts of the patient's legs and possibly also adjacent parts of the lower body.

In the continuation of this disclosure, use will be made of the expressions "longitudinal" and "longitudinal direction" or corresponding expressions. This is taken to signify the orientation of means which are substantially directed towards both the front and rear (the back support portion) portions of the apparatus, or point in a direction which may be related to the direction between the front and rear portions of the apparatus.

The front seat portion 21 is displaceable between a first position (cf. FIG. 4*a*) where the two seat portions form seat surfaces for a person located in the apparatus, and a second position (cf. FIG. 5*a*) where the front seat portion 21 has been displaced upwards and away from the rear seat portion 22. Via a connection member 25, the front seat portion 21 is connected to the frame 50.

The Figures show embodiments where the connection member 25 is also designed so as to form arm supports 25*a*. Via fixing members 26, a lower leg support 30 is movably connected to the rear seat portion 22. The distance between the lower leg support and the rear seat portion is adapted to the length of the front seat portion, in order to permit this to be moved down and placed between the rear seat portion and the lower leg support.

FIGS. 3*a* and 3*b* show one embodiment of the frame 50, FIG. 3*a* showing the chassis 40 of the frame which is designed with two spaced apart longitudinal carrier devices 43*a,b,* to which the wheels 41 are connected. The carrier devices are interconnected via a transverse beam 44. On the one side of the transverse beam, the carrier devices are provided at the end regions with connecting devices 45*a,b* in which the chassis connects to a lifting frame 51 (FIG. 3*b*) included in the frame. This is designed with two longitudinal lifting arms 54*a,b* which are interconnected to one another via a cross stay 55. In the front end portion 52 of the lifting frame, the lifting frame is rotatably journalled in the chassis 40 so as to be rotated about a substantially horizontal geometric axis 42. In its rear end portion 53, the lifting frame supports the back support 10 and the seat 20. The rear end portion is provided with journals 57*a,b* for the interconnection of the frame with a back support (FIG. 3*f*) described below. In FIG. 3*b,* there is inlaid a substantially horizontal geometric axis 56 which passes through the rear journals 57*a,b* of the frame.

FIGS. 3*c–d* show one embodiment of the seat 20 where this includes the front seat portion 21 (FIG. 3*d*) and the rear seat portion 22 (FIG. 3*c*). The rear seat portion includes two spaced apart support members 22*a,b* which between them form a slot 23. The slot is oriented in the longitudinal direction of the apparatus. The two support members are united via a U-shaped member 60 which projects out forwards from the support members 22*a,b*. The shanks 26*a,b* in the U-shaped member form the above-disclosed fixing members 26*a,b* between the lower leg support 30 and the rear seat portion 22. In the rearwardly facing end of the support members, there are disposed connection members 27*a,b* in which the rear seat portion is interconnected with the second end portions 53 of the lifting frame 51. In the interconnection, a rotary interconnection is formed between the lifting frame and the rear seat portion. This is, as a result, rotary about the horizontal geometric axis 56. In connection with the longitudinal edge portions 28*a,b* of the support members facing away from one another, there are provided rearwardly projecting retainer members 66*a,b* which, in their ends support the connection members 27*a,b*. Between the support members 22*a,b,* the rearwardly projecting retainer members 66*a,b* and the geometric axis 56, there is formed an open space 29.

The front seat portion 21 is generally provided with a recess 24 (FIG. 3*d*) which, with the front seat portion placed adjacent the rear seat portion, forms a continuation of the slot 23 of the rear seat portion.

FIG. 3*d* shows one embodiment of the connection members 25 where these, in their rear ends 65*a,b,* are provided with journal members 64*a,b* for journalling of the connection members in the frame 50. In the journal members 64*a,b,* the connection members are rotary about the substantially horizontal geometric axis 56 through the rear journals 57*a,b* of the frame.

FIG. 3*e* shows one embodiment of a lower leg support 30 which is rotatably journalled in the front edge of the U-shaped member 60 of the support members 22*a,b,* including the above-disclosed fixing members (shanks) 25*a,b*. The lower leg support 30 is disposed to be rotated about a substantially horizontal geometric axis 61 in the front edge of the U-shaped member 60.

FIG. 3*f* shows one embodiment of a back support 10 which, in its lower region, is provided with journal members 12*a,b* in which the back support is rotatably connected to the rear journals 57*a,b* of the frame 50. In the journals 57*a,b,* the back support is rotary in the substantially horizontal geometric axis 56 of the frame. The journals 12*a,b* are disposed in the ends of downwardly projecting retainer members 13*a,b*. Between the retainer members and the lower edge of the back support, there will hereby be formed an open space 14. In certain embodiments, the back support is provided with a sling or harness 15 which ensures that a patient placed in the apparatus does not run the risk of falling out of the apparatus. The sling or harness is principally intended to be employed for restless and unstable patients. The back support is generally provided with at least one handle 16.

FIG. 4 shows one embodiment of the apparatus including the frame 50 with the chassis 40 and moreover including the seat 20, the lower leg support 30 and the back support 10 once these units have been assembled to form the apparatus. The apparatus also includes drive means (not shown in the Figure) for displacing the lifting frame 51, the seat 20, the lower leg support 30 and the back support 10. As a rule, such drive means are designed as electric drive means or hydraulic drive means. These are connected to batteries (not shown in the Figures). The apparatus according to the invention also includes operating devices (not shown in the Figures) which are usually connected to the apparatus in connection with its being employed. It will be obvious to the skilled reader that, in other embodiments, the operating devices are fixedly connected or are included in the apparatus.

FIG. 4*b* shows the apparatus with a patient 2 sitting in it when the apparatus has been set as shown in FIG. 4*a*. In the Figure, the seat 20 and the back support 10 are shown in positions where the patient 2 is substantially entirely supported by the seat. For this setting of the apparatus, it will be disclosed below that the apparatus is set at position I.

FIG. 5*a* shows the apparatus according to FIG. 4*a* but in a reclining position. The lifting frame 51 has been pivoted up, the back support 10 has been pivoted rearwards in relation to the lifting frame 51, the front seat portion 21 of the seat 20 and the lower leg support 30 have been lifted upwards.

FIG. 5*b* shows the apparatus with the patient 2 sitting in the apparatus when this has been switched as shown in FIG. 5*a*. It will be apparent from the Figure that the lower abdominal area has become completely accessible for, for example washing or for removing the patient's trousers. In the Figure, the seat 20 and the back support 10 are shown in positions where the patient 2 is substantially totally supported by the back support. For this setting of the apparatus, it will be stated below that the apparatus is set in position II.

In a first alternative for use of the apparatus, the patient who is to be assisted is placed in the apparatus when it is set as shown in FIGS. 4*a* and 4*b*. The apparatus is then in position I. The apparatus is thereafter moved to, for example, a toilet facility. On arrival, the carer, if necessary, leans the patient forwards so that clothing in the area of the lower abdomen is not pinched between the back support and the patient. Alternatively, the patient assumes a sitting posture in which the lower part of the back does not abut against the back support. The major proportion of the patient's weight is now carried by the seat of the apparatus, position I. The patient's clothes are drawn away from the region where the body is not supported by the apparatus. The above-described open space 14 of the back support and the open space 29 of the seat 20 entail that, for example, for a patient wearing trousers, the band of the trousers is moved down to the upper area of the thigh.

Thereafter, the apparatus is switched to the position illustrated in FIGS. 5*a* and 5*b,* in which the major proportion of the weight of the patient is carried by the back support. The abutment of the legs against the rear seat portion 22 has substantially completely ceased, while the lower parts of the thighs abut against the front seat portion 21. The apparatus is now located in position II. When necessary, the band of the trousers is drawn down along the thighs to a position adjacent the front seat portion. On those occasions when it is necessary for the trousers to be removed completely, it is easy for a carer, if needed, to lift, for example, one leg at a time in order to make it possible to remove the patient's trousers completely. As a rule, the apparatus is returned to position I in those cases when it is necessary to remove the patient's trousers entirely.

When the apparatus has been reset to the position illustrated in FIGS. 4*a,b,* the slot 23 and the recess 24 make it possible for the patient to defecate and/or urinate. When this has taken place, the apparatus is generally set in an inclining position (cf. FIGS. 5*a,b*) for example for washing the patient. When this is completed, dressing of the patient takes place in the reverse order, whereafter the patient is returned, for example, to a bed or a chair.

When the apparatus is set in the position as shown in FIGS. 5*a,b,* i.e. is in position II, the patient's lower abdominal area is readily accessible, for example, for washing. It will be apparent from the above-described function that a toilet visit may also be carried out without the carer needing to be subjected to heavy lifting operations. As a result, the possibilities are also facilitated of transporting a person in need of help in the clothed state to and from, for example, a toilet or a shower facility.

The position of the apparatus as shown in FIGS. 5*a* and 5*b* is also usable for other purposes, for example, for medical examination or for medical treatment of a patient placed in the apparatus.

In the simplified embodiment of the apparatus as shown in FIGS. 1*a* and *b,* the seat 20 is not divisible. In order to compensate for the absence of the possibility of lifting only the front seat portion 21 of the seat, the open space 14 of the back support and the open space 29 of the seat 20 are, as a rule, deeper than in the embodiments in which the seat 20 includes a front seat portion 21 movable in relation to the rear seat portion 22. The term "deeper" is taken to signify that the recesses which form the spaces 14,29 pass further up in the back support and further into the seat than in the embodiment with front and rear seat portions which are movable in relation to one another. This is generally attained in that the length of the retainer members 13*a,b* of the back support (cf. FIG. 3*f*) and the retainer members 66*a,b* (cf. FIG. 3*c*) for the connection members 27 of the seat are longer than in the embodiment comprising separable front and rear seat portions. The increased space entails that the distance between the rear edge 67 of the seat and the lower edge 17 of the back support is greater than in the embodiment comprising movable front and rear seat portions 21,22.

In order to achieve the sought-for effect, the back support 10 is disposed to be pivoted to a position where the back support slopes rearwardly to an extent which entails that the front side of the back support makes an angle with a vertical axis of at least approx. 35° and, as a rule, an angle of at least 45°. As a rule, the apparatus is designed to retain the angle between the seat 20 and the back support 10 substantially unchanged when the back support is pivoted to its rearwardly inclined position. It generally applies that the angles are selected such that, in the rearwardly inclined position (position II), at least 60% and, as a rule, at least approx. 70% of the weight of the patient is carried by the back support when this is located in the rearwardly inclined position. In the upright position, i.e. in position I, the seat carries, as a rule, at least approx. 80% and normally at least approx. 90% of the patient's weight. Expressed otherwise, the angles are selected such that, in position I, the major proportion of the patient's weight is carried by the seat, and in position II by the back support.

In the foregoing description, it has been disclosed that both seat portions 21,22 of the seat 20 and the back support 10 are journalled so as to be rotated about a geometric axis 56 which is common to all of these devices. It will be obvious to a person skilled in the art that, in other embodiments, the seat portions and/or back support are journalled in order that all devices, or at least some of the devices can be pivoted about a geometric axis which differs from the geometric axis or axes the remaining devices rotate about.

It will be further obvious to a person skilled in the art that the apparatus is also switchable to a position in which the back support 10, the seat 20 and the lower leg support 30 form upwardly facing surfaces located substantially in the same plane. In this position, the apparatus forms a cot or a bed-like device. In applications where the apparatus is intended to be used more frequently as a bed as well, the back support 10, the seat 20 and the lower leg support 30 are each provided with a mattress-like layer individual for each separate device. In this embodiment, the apparatus forms both a bed and also an apparatus for facilitating, in handicapped people or patients, the undressing and dressing of the lower abdominal area and also for facilitating access to this area. For this practical application, the apparatus is provided with retainer members which carry at least one removable support member which is provided with a mattress-like layer and which covers the region 11 between the rear edge 67 of the seat and the lower edge 17 of the back support.

Concerning the movements of the rotary devices included in the apparatus (lifting frame, seat, front seat portion, rear seat portion or back support), the apparatus encompasses all variations of rotary movements from each device's rotary movement taking place independently of that of the other devices and to the rotary movements of two, more or all devices taking place simultaneously. In certain cases, two or more devices retain the size of the angles between the devices during their rotary movements.

The foregoing description has referred to but a limited number of embodiments of the present invention. A person skilled in the art will readily perceive that the present invention encompasses a large number of embodiments without departing from the scope of the appended Claims.

What is claimed is:

1. An apparatus for supporting a person so as to facilitate undressing, dressing or access to the lower abdominal area of the person, the apparatus comprising:

a) a seat;

b) a back support; and c) means for supporting the seat and the back support with an open area between them, wherein the seat comprises a forward seat portion and a rear seat portion, the apparatus comprising means for displacing the forward seat portion between (i) a first position wherein the forward seat portion is adjacent the rear seat portion such that, with the person supported in the apparatus, the forward seat portion supports the lower regions of the thighs of the person and the rear seat portion supports the upper regions of the thighs, and (ii) a second position wherein the forward seat portion is displaced from the rear seat portion such that, with the person supported in the apparatus, the front seat portion holds up the lower regions of the thighs and releases the upper regions of the thighs from the rear seat portion.

2. The apparatus as claimed in claim 1, wherein the apparatus comprises second journal means for displacement of the rear seat portion and the back support relative to one another to permit adjustment of an inclination of the back support or an angle between the rear seat portion and the back support or both.

3. The apparatus as claimed in claim 1, wherein the rear seat portion of the seat includes a plurality of spaced apart support portions which between them form a slot that is oriented in a direction that is longitudinal to the thighs of a patient supported in the apparatus.

4. The apparatus as claimed in claim 3, wherein the forward seat portion of the seat comprises a recess which forms a continuation of the slot.

5. The apparatus as claimed in claim 1, wherein the forward seat portion comprises a plurality of arm supports.

6. The apparatus as claimed in claim 1, comprising a lower leg support and means for displacing the lower leg support in relation to the seat.

7. The apparatus as claimed in claim 6, comprising fixing member means for fixing the lower leg support to the rear seat portion with a space therebetween such that the forward seat portion is disposed between the rear seat portion and the lower leg support with the forward seat portion in said first position.

8. The apparatus as claimed in claim 7, comprising third journal means for pivoting the lower leg support about a substantially horizontal axis at a portion of the lower leg support proximal to the seat and means for displacing the lower leg support to a position wherein it forms a foot support for the person with the back support disposed in position II.

9. The apparatus as claimed in claim 1, wherein the means for supporting the seat and the back support comprises a frame, said frame comprising a chassis, a lifting frame having first and second end portions, and first journal means for pivotal movement of the first end portion of the lifting frame about a substantially horizontal axis such that the first end portion is rotatably journalled in the chassis below the seat and back support, the second end portion of the lifting frame supporting the seat and the back support in any of a plurality of positions, including a position I wherein the person is supportable in the apparatus with a major portion of the person's weight carried by the seat and a position II wherein the person is supportable in the apparatus with a major portion of the patient's weight carried by the back support.

10. The apparatus as claimed in claim 1, wherein the chassis is provided with wheels.

* * * * *